US011326767B1

(12) United States Patent
Del Vecchio et al.

(10) Patent No.: US 11,326,767 B1
(45) Date of Patent: May 10, 2022

(54) FOLDING HAND FAN WITH ILLUMINATED RIBS

(71) Applicant: Consilium Enterprises, Inc., Los Angeles, CA (US)

(72) Inventors: Paolo Del Vecchio, Los Angeles, CA (US); Jada Miranda, Los Angeles, CA (US); Chen Yanli, Fujian (CN)

(73) Assignee: CONSILIUM ENTERPRISES, INC., Los Angeles, CA (US)

( * ) Notice: Subject to any disclaimer, the term of this patent is extended or adjusted under 35 U.S.C. 154(b) by 0 days.

(21) Appl. No.: 17/128,540

(22) Filed: Dec. 21, 2020

(51) Int. Cl.

| | |
|---|---|
| ***F21V 23/04*** | (2006.01) |
| ***F21V 11/00*** | (2015.01) |
| ***A45B 27/00*** | (2006.01) |
| ***F21L 4/08*** | (2006.01) |

(52) U.S. Cl.
CPC ..... *F21V 23/0414* (2013.01); *A45B 27/00* (2013.01); *F21L 4/08* (2013.01); *F21V 11/00* (2013.01); *F21V 23/0435* (2013.01)

(58) Field of Classification Search
CPC .. F21V 23/0414; F21V 11/00; F21V 23/0435; F21V 33/00; F21V 33/0004; F21V 33/008; F21V 33/0084; A45B 27/00; F21L 4/08
See application file for complete search history.

(56) References Cited

U.S. PATENT DOCUMENTS

| | | | | |
|---|---|---|---|---|
| 2002/0172597 | A1* | 11/2002 | Shiratori | A45B 27/00 416/5 |
| 2007/0188986 | A1* | 8/2007 | Kobayashi | G09F 27/00 361/679.06 |
| 2007/0243072 | A1* | 10/2007 | Tepporn | F21K 2/06 416/70 A |
| 2018/0160782 | A1* | 6/2018 | Wong | F04D 29/005 |

FOREIGN PATENT DOCUMENTS

| | | | |
|---|---|---|---|
| JP | 3156335 | U9 | 12/2009 |
| JP | 2016073565 | A | 5/2016 |
| KR | 1020020088025 | | 11/2002 |
| KR | 101506400 | B1 | 3/2015 |

OTHER PUBLICATIONS

Alibaba, Custom Artificial Led Folding Fan, Flashing Handy Fan With Lights—Buy Custom Printed Folding Hand Fan, Led Lighted Hand Fans, https://www.alibaba.com/product-detail/Custom-Aritificial-led-folding-fan-flashing_60438150664.html?spm=a2700.details.deiletai6.4.7d4411c2at4ng0.

(Continued)

*Primary Examiner* — Bao Q Truong
(74) *Attorney, Agent, or Firm* — Anooj Patel; Kevin Schraven; Hankin Patent Law, APC

(57) ABSTRACT

An illuminated rib for a folding hand fan comprising: a housing; and a lighting assembly, which comprises one or more light sources; wherein the lighting assembly is configured to be substantially encased within the housing; wherein when the lighting assembly is turned on a light from (Continued)

the one or more light sources is visible through the housing; and wherein the illuminated rib for the folding hand fan is configured to be operatively connected to one or more additional ribs and a leaf of the folding hand fan.

19 Claims, 7 Drawing Sheets

(56) References Cited

OTHER PUBLICATIONS

Aliexpress, 16pcs Colorful Led Luminous Folding Fan Led Light Up Stage Performance Props Music Festival Party Event Led Illuminated Fan, https://www.aliexpress.com/item/4001263406600.html.
The International Searching Authority, International Search Report, dated Mar. 16, 2022, 3 pages, United States.
The International Searching Authority, Written Opinion of the International Searching Authority, dated Mar. 16, 2022, 4 pages, United States.

* cited by examiner

FOLDING HAND FAN WITH ILLUMINATED RIBS

FIELD OF USE

The present disclosure relates generally to the field of hand fans, and more specifically to a hand fan with a light emitting source enclosed within its guards or ribs.

BACKGROUND

Folding hand fans are very commonly painted or otherwise decorated, allowing users to customize their appearance. The ability to decorate and customize a folding hand fan is an essential part of its appeal, in addition to its obvious function of self-cooling by fanning. Traditional folding hand fans comprise a series of ribs, made of bamboo, wood, plastic, or metal, and a fabric covering that is attached to the ribs. As the fan is spread out, the ribs stretch the fabric to create a sheet of fabric that can be used to fan oneself.

Fans have been regularly decorated and customized in a variety of ways, such as through painting or ornate wood carvings. However, before the fan of the present disclosure there was not a folding hand fan that contains a light emitting source within its ribs and/or guards. A folding hand fan with lights in its ribs and/or guards is a novel way to customize a fan, and would be very useful in, for example, the rave, ball, or party scene.

Thus, there is a need for a folding hand fan comprising a light source within its end ribs, allowing users greater customization options for their fans as well as the ability to use it in the dark, e.g. for raves or parties.

SUMMARY

To minimize the limitations in the cited references, and to minimize other limitations that will become apparent upon reading and understanding the present specification, the present specification discloses a folding fan that has illuminated guards or ribs. The illumination elements are preferably contained entirely within the ribs and/or guards.

One embodiment may be an illuminated rib and/or guard for a folding hand fan comprising: a housing; and a lighting assembly, which comprises one or more light sources; wherein the lighting assembly is configured to be substantially encased within the housing; wherein when the lighting assembly is turned on a light from the one or more light sources is visible through one or more portions of the housing; and wherein the illuminated guard for the folding hand fan is configured to be operatively connected to one or more ribs and a leaf of the folding hand fan, such that when the folding hand fan is in an open or closed position the light from the one or more light sources is visible. The lighting assembly may further comprise a power source, a lighting board, and a control button. The control button may be configured to control the light sources including, but not limited to turning them off, turning them on, strobing them, alternating them, altering the illumination levels (brighter/dimmer), changing colors and alternating designs. The housing may comprises at least one screen or lighting screen that may be configured to cover the one or more light sources and allow the light from the one or more light sources to pass through the at least one screen and be visible. The at least one screen may be translucent such that the light from the light sources passes through the at least one screen but the one or more light sources are not clearly visible through the at least one screen. The power source may comprise a rechargeable battery that may be charged via wired or wireless mechanisms. The lighting board may comprise a charging port that is configured to be accessible through the housing. The lighting board may comprise a wireless module that allows the one or more light sources to be controlled wired or wirelessly. The one or more light sources may be selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

Another embodiment may be an illuminated rib and/or guard for a folding hand fan comprising: a housing that comprises one or more screens; and a lighting assembly, which comprises one or more light sources, a power source, a lighting board, and a control button; wherein the power source comprises a rechargeable battery; wherein the lighting assembly is configured to be substantially encased within the housing; wherein when the lighting assembly is turned on a light from the one or more light sources is visible through one or more portions of the housing; and wherein the illuminated guard for the folding hand fan is configured to be operatively connected to one or more ribs and a leaf of the folding hand fan, such that when the folding hand fan is in an open or closed position the light from the one or more light sources is visible. The control button may be configured to turn off the one or more light sources, turn on the one or more light sources, and alter an illumination of the light sources, and otherwise control the light source. The at least one screen may be configured to cover the one or more light sources and allow the light from the one or more light sources to pass through the at least one screen and be visible. The at least one screen may be translucent such that the light from the light sources passes through the at least one screen but the one or more light sources are not clearly visible through the at least one screen. The lighting board may comprise a charging port that is configured to be accessible through the housing. The power source may further comprise a wireless charging coil. The lighting board may comprise a wireless module that allows the one or more light sources to be controlled wirelessly. The one or more light sources may be selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

Another embodiment may be an illuminated guard for a folding hand fan comprising: a housing that comprises one or more screens; and a lighting assembly, which comprises one or more light sources, a power source, a lighting board, and a control button; wherein the power source comprises a rechargeable battery; wherein the lighting assembly is configured to be substantially encased within the housing; wherein when the lighting assembly is turned on a light from the one or more light sources is visible through one or more portions of the housing; wherein the illuminated guard for the folding hand fan is configured to be operatively connected to one or more ribs and a leaf of the folding hand fan, such that when the folding hand fan is in an open or closed position the light from the one or more light sources is visible; wherein the control button is configured to control the one or more light sources; wherein the at least one screen is configured to cover the one or more light sources and allow the light from the one or more light sources to pass through the at least one screen and be visible; and wherein the one or more light sources are selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

Another embodiment may be an illuminated rib for a folding hand fan comprising: a housing; and a lighting assembly, which comprises one or more light sources, a power source, a lighting board, and a control button; wherein the power source comprises a battery; wherein the lighting assembly is configured to be substantially encased within the housing; wherein when the lighting assembly is turned on a light from the one or more light sources is emanates through one or more translucent or transparent portions of the housing; and wherein the illuminated rib for the folding hand fan is configured to be operatively connected to one or more additional ribs and a leaf of the folding hand fan. The control button may be configured to turn off the one or more light sources, turn on the one or more light sources, and alter an illumination of the light sources. The lighting board may comprise a wireless module that allows the one or more light sources to be controlled wirelessly. The one or more light sources are selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

Another embodiment may be an illuminated rib for a folding hand fan comprising: a housing; one or more light sources; a battery, and a control button; wherein the battery and the one or more light sources are configured to be substantially encased within the housing; wherein the one or more light sources are configured to be adjacent to an inner surface of the housing; and wherein the illuminated rib for the folding hand fan is configured to be operatively connected to one or more additional ribs and a leaf of the folding hand fan. The control button may be configured to control the one or more light sources. The one or more light sources may be selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

One embodiment of the present disclosure may be a folding fan that has an illumination element or light inside of a guard of a folding fan wherein the light emitted emanates both outward and inward.

One embodiment of the present disclosure may be a folding fan with programmable, changeable, and adjustable lights within a guard of the fan.

One embodiment of the present disclosure may be folding fan that has a rechargeable or changeable battery within the rib that powers the illumination element. Preferably, the battery and lighting elements are securely protected and encased within the rib or guard.

It is an object to provide lighting within a guard of a folding fan such that the lighting components are protected.

Other features and advantages are inherent in the folding fan that is claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
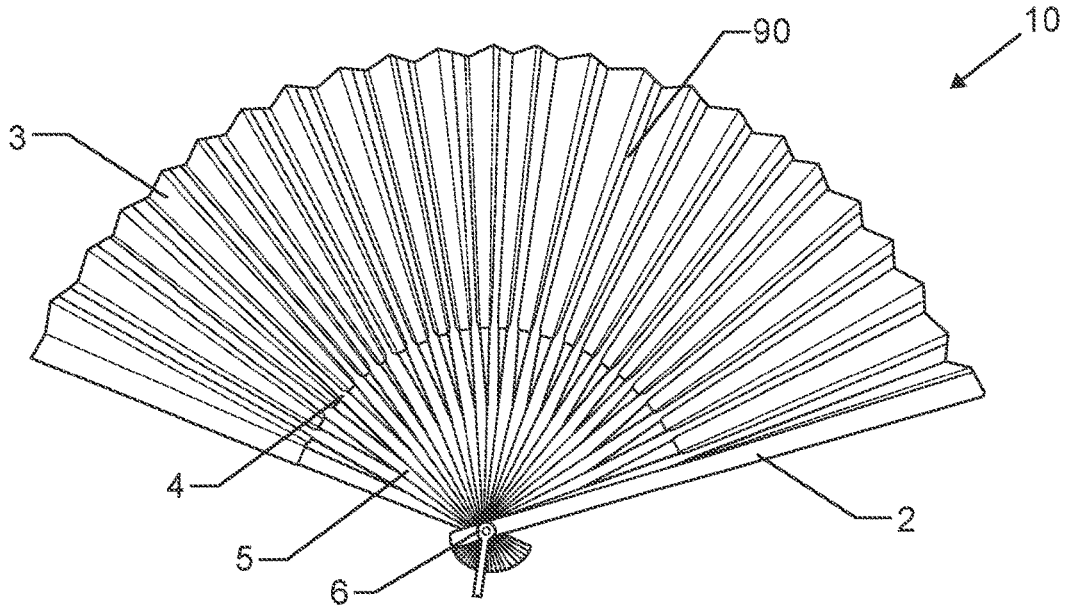
[PRIOR ART] Fig.1
FIG. 1 is an illustration of standard folding hand fan

In the following detailed description of various embodiments, numerous specific details are set forth in order to provide a thorough understanding of various aspects of the embodiments. However, these embodiments may be practiced without some or all of these specific details. In other instances, well-known methods, procedures, and/or components have not been described in detail so as not to unnecessarily obscure aspects of the embodiments.

While multiple embodiments are disclosed, still others will become apparent to those skilled in the art from the following detailed description. As will be realized, these embodiments are capable of modifications in various obvious aspects, all without departing from the spirit and scope of protection. Accordingly, the graphs, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about," may refer to a deviance of between 0.0001-10% from the indicated number or range of numbers.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are signified both in relation to the other endpoint, and independently of the other endpoint.

"Optional" or "optionally" means that the subsequently described event or circumstance may or may not occur, and that the description includes instances where the event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that may be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all embodiments of this application including, but not limited to, steps in disclosed methods. Thus, if there are a variety of additional steps that may be performed it is understood that each of these additional steps may be performed with any specific embodiment or combination of embodiments of the disclosed methods.

The present methods and systems may be understood more readily by reference to the following detailed description of preferred embodiments and the examples included therein and to the Figures and their previous and following description.

Various embodiments are now described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments. It is to be understood that the methods and systems are not limited to specific methods, specific components, or to particular implementations. It is also to be understood that the terminology used herein is for the purpose of describing particular embodiments only and is not intended to be limiting.

In the following description, certain terminology is used to describe certain features of one or more embodiments. For purposes of the specification, unless otherwise specified, the term guard refers to the two outermost ribs of a foldable hand fan. The term rib, which includes the guards, refers to the elongated and substantially rigid structures that form the backbones of the folding fan. The illuminated ribs are preferably made of plastic so as to be easily shaped to be hollow and contain the electrical, power, and lighting components.

FIG. 1 is an illustration of standard folding hand fan. As shown in FIG. 1, the standard folding hand fan 10 that is well known in the prior art, may comprise a guard 2, ribs 90, leaf 3, shoulders 4, sticks 5, and connection point 6. The ribs 90 and guard 2 may be connected at their respective proximal ends via a pivot pin that is part of connection point 6. The folding hand fan 10 in FIG. 1 is shown in an open configuration, such that the guard 2 and ribs 90 are spaced, or fanned, apart. This open configuration allows the leaf 3 attached to the guard 2 and ribs 90 to be substantially unfolded and flat, which may be usable to move air and cool a user. Although some fans of the prior art have been known to include lighting strips glued to an outer surface of the ribs, no prior folding hand fan has integrated a lighting unit securely into the fan guard.

Figure 2A:
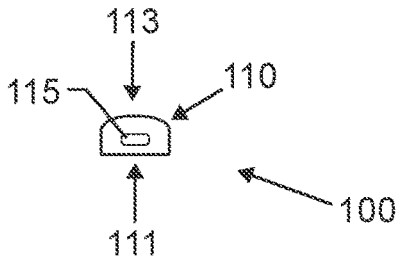
FIG. 2*a* is an illustration of a top view of one embodiment of a fan rib.

FIG. 2*a* is an illustration of a top view of one embodiment of a fan rib. FIG. 2*a* shows that the rib 100 may be a guard or end rib, but rib 100 may be an interior rib or an end rib. As shown in FIG. 2*a*, rib 100 may have a charging port 115 at the top 110 of the rib 100. FIG. 2*a* shows that the rib 100 may have a rounded rear side 113 or face, that, when the fan is closed, is the face that is exposed. FIG. 2*a* shows that the rib 100 may have a substantially flat front side 111 or face, that, when the fan is closed, is the face that is covered and abuts the leaf and interior ribs/sticks.

Figure 2B:
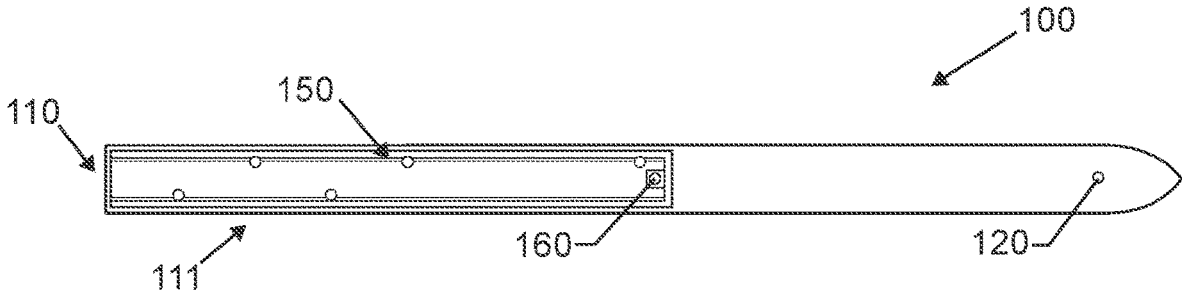
FIG. 2*b* is an illustration of a front view of one embodiment of a fan rib.

FIG. 2*b* is an illustration of a front view of one embodiment of a fan rib. FIG. 2*b* shows that the rib 100 may have a hole 120 that is configured to allow the rib to connect to the ribs and opposite rib via a rivet or bolt. The rib 100 may have a lighting board 150 that may have a plurality of light emitting diodes (LED), which provide illumination when turned on via on/off button 160. The lighting elements of the rib 100 may be any type of lighting device, including, but not limited to: LED, organic light emitting diode (OLED), electroluminescent (EL) diode (wherein an emissive electroluminescent layer is a film compound that emits light in response to an electric current), organic EL diode (OEL), incandescent bulb, full array light emitting diodes (Full Array LED), quantum dot light emitting diodes (QLED), liquid crystal displays (LCD), plasma, and the like. Preferably the lighting elements are bright, but do not require a lot of power, which is why an LED type of light is preferred.

Figure 3:
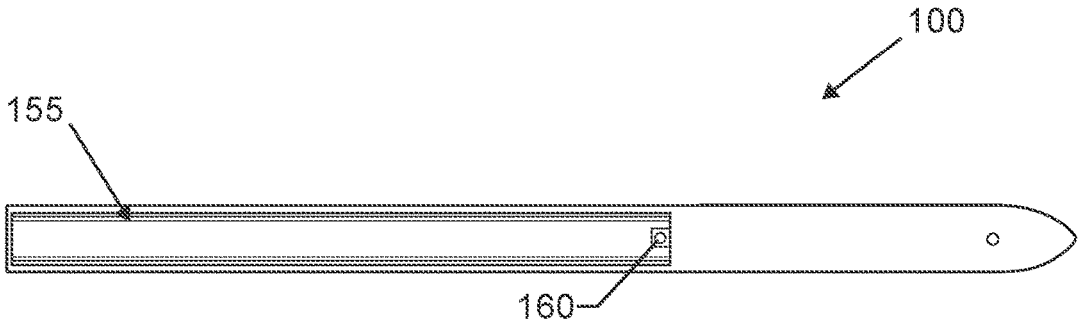
FIG. 3 is an illustration of a front view of one embodiment of a fan rib.

FIG. 3 is an illustration of a front view of one embodiment of a fan rib. FIG. 3 shows that rib 100 may comprise a screen 155 (also referred to as a light screen or lighting screen), which may be a transparent or translucent light diffuser or lens. Screen 155 preferably protects the light panel 150 from damage, including water damage.

Figure 4A:
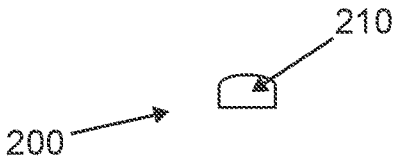
FIG. 4*a* is an illustration of a top view of one embodiment of a fan rib.

FIG. 4*a* is an illustration of a top view of one embodiment of a fan rib. In this embodiment, the top 210 of rib 200 has no charging port, because the rib 200 may be configured for wireless charging.

Figure 4B:
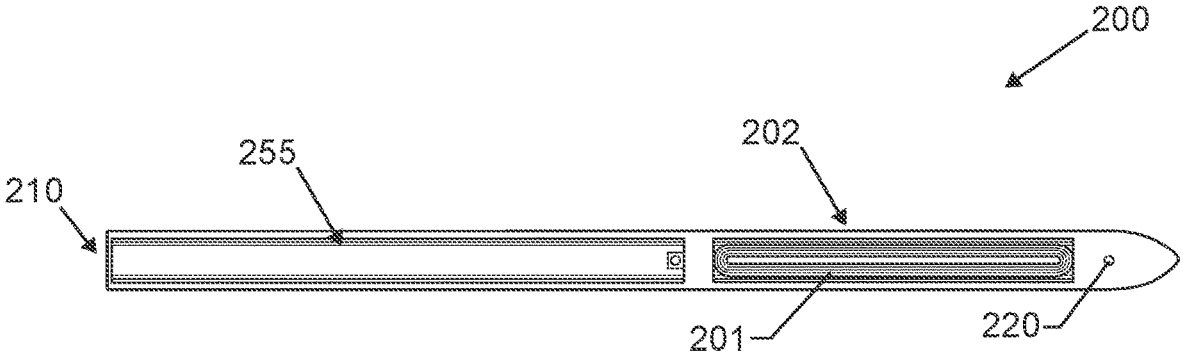
FIG. 4*b* is an illustration of a front view of one embodiment of a fan rib.

FIG. 4*b* is an illustration of a front view of one embodiment of a fan rib. FIG. 4*b* shows that the rib 200 may have a hole 220 that is configured to allow the rib 200 to connect to the ribs and an opposite rib via a rivet or bolt. FIG. 4*b* shows the light board is covered by a lighting screen 255. FIG. 4*b* also shows that a portion of the housing of rib 200 is cut away to show a wireless charging cord. As shown, the rib 200 may have a charger 201 and charging coils 202. One standard type of wireless charging coil that may be used is the Qi charger, which has an open interface standard that defines wireless power transfer using inductive charging over distances of up to 4 cm (1.6 inches). The Qi system uses a charging pad and a compatible device, which is placed on top of the pad, charging via resonant inductive coupling.

Figure 5:
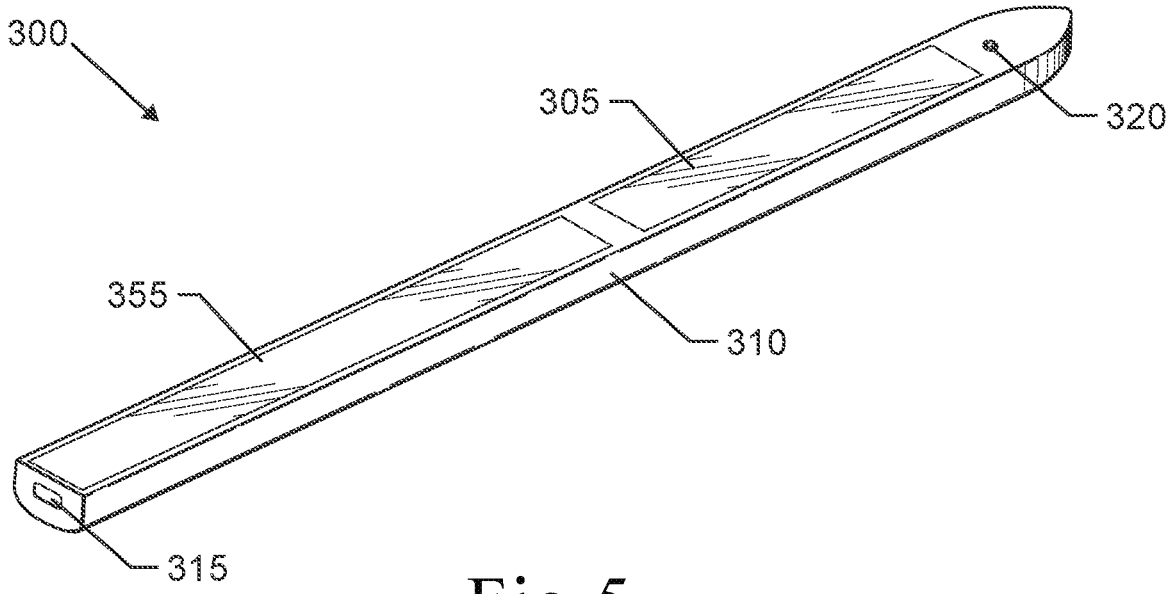
FIG. 5 is an illustration of a front view of one embodiment of a fan rib.

FIG. 5 is an illustration of a front view of one embodiment of a fan rib. As shown in FIG. 5, the rib 300 may comprise a housing 310, lighting screen 355, panel 305, rivet accepting portion 320, and charging port 315. The housing 310 may be plastic, wood, metal, or a composite material, so long as it houses and protects the lighting, power, and electronic elements of the rib 300. The screen 355 may be translucent or transparent, depending on how much illumination is desired. Although screen 355 is shown only at a top portion of rib 300, the lighting element and screen may run any length along the front (and/or back) face of rib 300.

Panel 305 may be a second lighting screen or may be an access panel providing access to the charger and or battery components of the rib 300. As shown, the housing 310, panel 305, and screen 355 preferably fit together so as to provide protection to the internal lighting, power, and electrical components.

In an alternate embodiment, the housing 310 itself may comprise a degree of transparency such that light generated within the housing 310 may pass through the housing 310, wherein the components housed within the housing 310 may, or may not, be visible through the housing 310.

The housing 310, panel 305, and screen 355 may be decorated or tinted to be any color desired.

The charging port 315 may be located on a distal or top end of the housing 310. The charging port 315 may be configured to accept one or more standard types of universal serial bus type plugs or propriety type plugs. The charging port 315 is preferably configured to allow the guard to accept an alternating current or direct current power charge.

Figure 6:
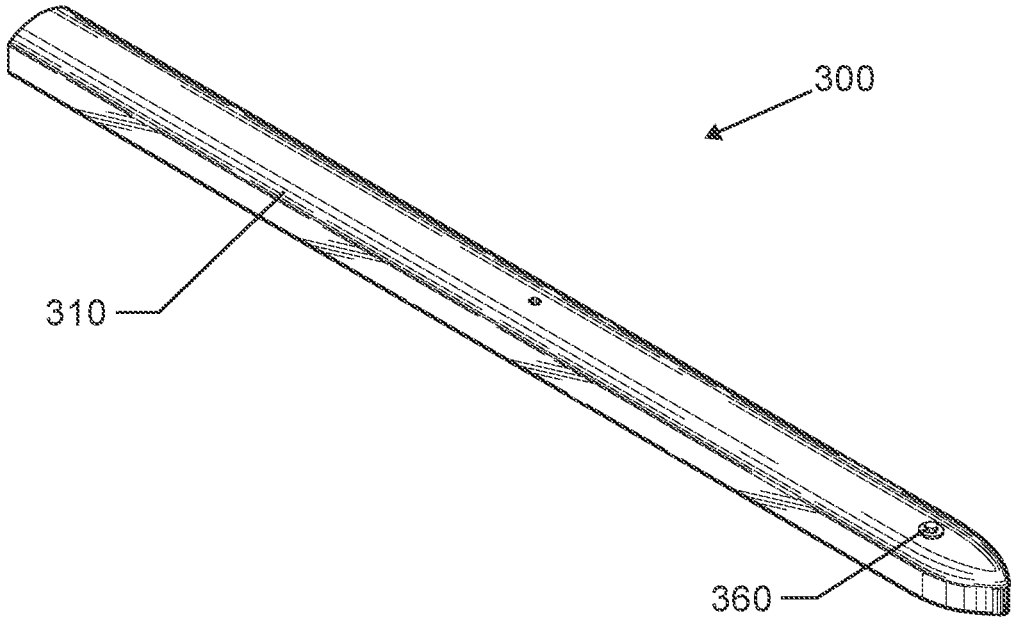
FIG. 6 is an illustration of a read view of one embodiment of a fan rib.

FIG. 6 is an illustration of a rear view of one embodiment of a fan guard. As shown, the guard 300 may comprise a housing 310 and a button 360. The button 360 may be the engagement mechanism that allows the user to turn on and off the lighting element and/or to switch the various lighting modes of the lighting element. The button may be located anywhere on the housing and may be a switch, touch pad, soft key, and the like.

Figure 7:
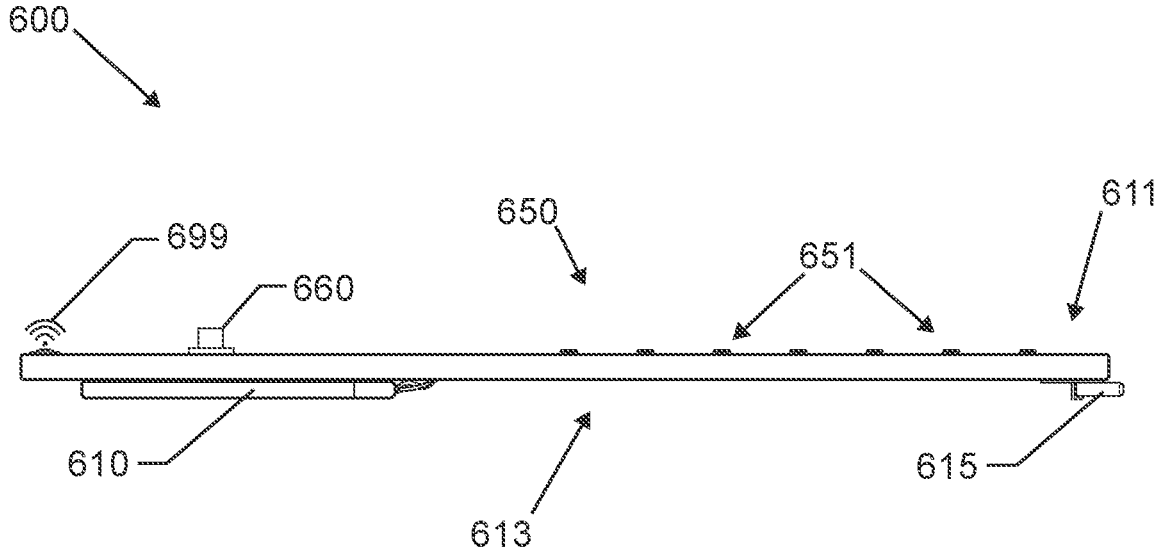
FIG. 7 is an illustration of a side view of the lighting assembly of one embodiment of a fan rib.

FIG. 7 is an illustration of a side view of the lighting assembly of one embodiment of a fan rib. As shown in FIG. 7, the lighting assembly 600 may comprise a light source 651, a power source 610, a lighting board 650, button 660, and charging engagement portion 615. The lighting assembly 600 is configured to be encased and protected by the housing. The light source 651 is preferably visible through the housing via a lighting screen or transparent portion of the housing. One advantage of encasing the lighting assembly 600 within the housing is that the lighting assembly 600 may be protected from outside elements, which is a substantial and unique improvement over fans that have lighting and wire elements on surfaces of the ribs.

The light source 651 and button 660 may be affixed to a top or front surface 611 of the lighting board 650, while the power source 610 may be affixed to a rear or bottom surface 613 of the lighting board 650.

The lighting board 650 may be a printed circuit board or the like. The lighting board 650 may be configured to electrically connect the light source 651, power source 610, and button 660.

The light source 651 may be an LED, OLED, QLED, Plasma, LCD, EL panel, or substantially any other form of lighting mechanism or illumination device. In some embodiments, the light source 651 may be a single row of lights. In some embodiments, the light source 651 may be multiple rows of lights. The light source 651 may be single or multi-colored.

The power source 610 may comprise a battery (single use or rechargeable) and a charging mechanism, if the battery is rechargeable, as preferred. The charging mechanism may comprise a wired charging port 615. In an alternate embodiment, the charging mechanism may be replaced with a wireless charging coil. In alternate embodiments, the power source 610 may comprise a cord or other mechanism that is attached to an external AC or DC power source.

The button 660 may be configured to, when actuated, toggle between an on and off lighting condition of the light source 651 by using power or electricity provided by the power source 610. In some embodiments, additional lighting conditions, programs, fades (in, out, and/or cyclical), and color changes, may be engaged, such as intermittent or flashing illumination, or specific patterns or images generated by the light source 651.

In some embodiments, the lighting assembly 600 may further comprise a communication module 699. The communication module 699 may be configured to communicate with a remote device, such as a smart phone, laptop, desktop, tablet, or other electronic computing device, such that the remote device may send to the lighting assembly 600 instructions and or commands to cause the light source 651 to activate, deactivate, or illuminate in a programmed manner. The communication module 699 may be a wireless communication module, as preferred, or a wired communication module. In one embodiment, the wired communication module 699 may receive communication through the wired charging port 615.

Figure 8:
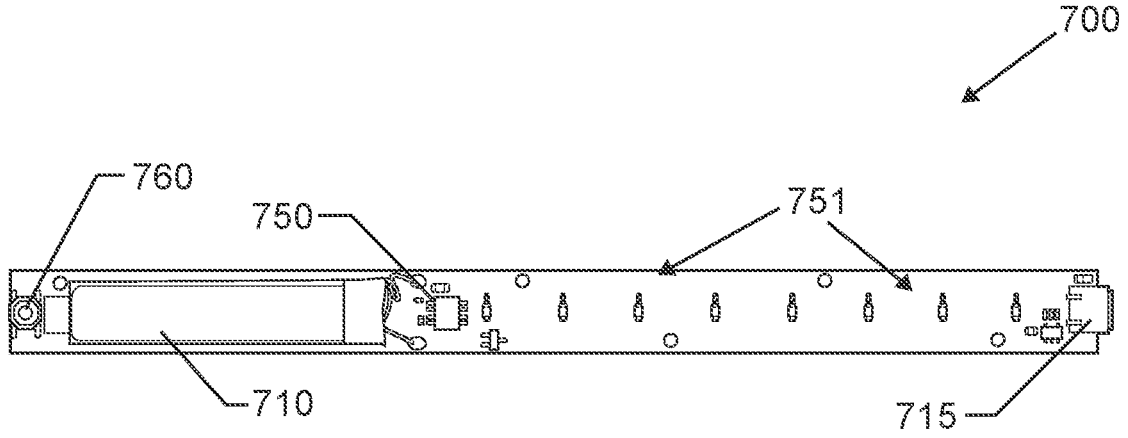
FIG. 8 is an illustration of a top view of the lighting assembly of one embodiment of a fan rib.

FIG. 8 is an illustration of a top view of the lighting assembly of one embodiment of a fan. As shown in FIG. 8, the lighting assembly 700 may comprise a light source 751, a power source 710, a lighting board 750, button 760, and charging engagement portion 715, and that all of the portions are on the front face of the lighting assembly 700. FIG. 8 shows that the lighting board 750 may comprise a charging port 715, which is preferably accessible to a charging plug through the housing.

In other embodiments, the button 760 may be a digital or analog switch that allows the user to manually control the light source 751. The button 760 may be accessible through the housing or it may be connected to a mechanism on the housing that actuates the button 760. In other embodiments, the button 760 may be a touch screen type button on the surface of the housing. The button 760 is also called a power switch or a control button.

Figure 9:
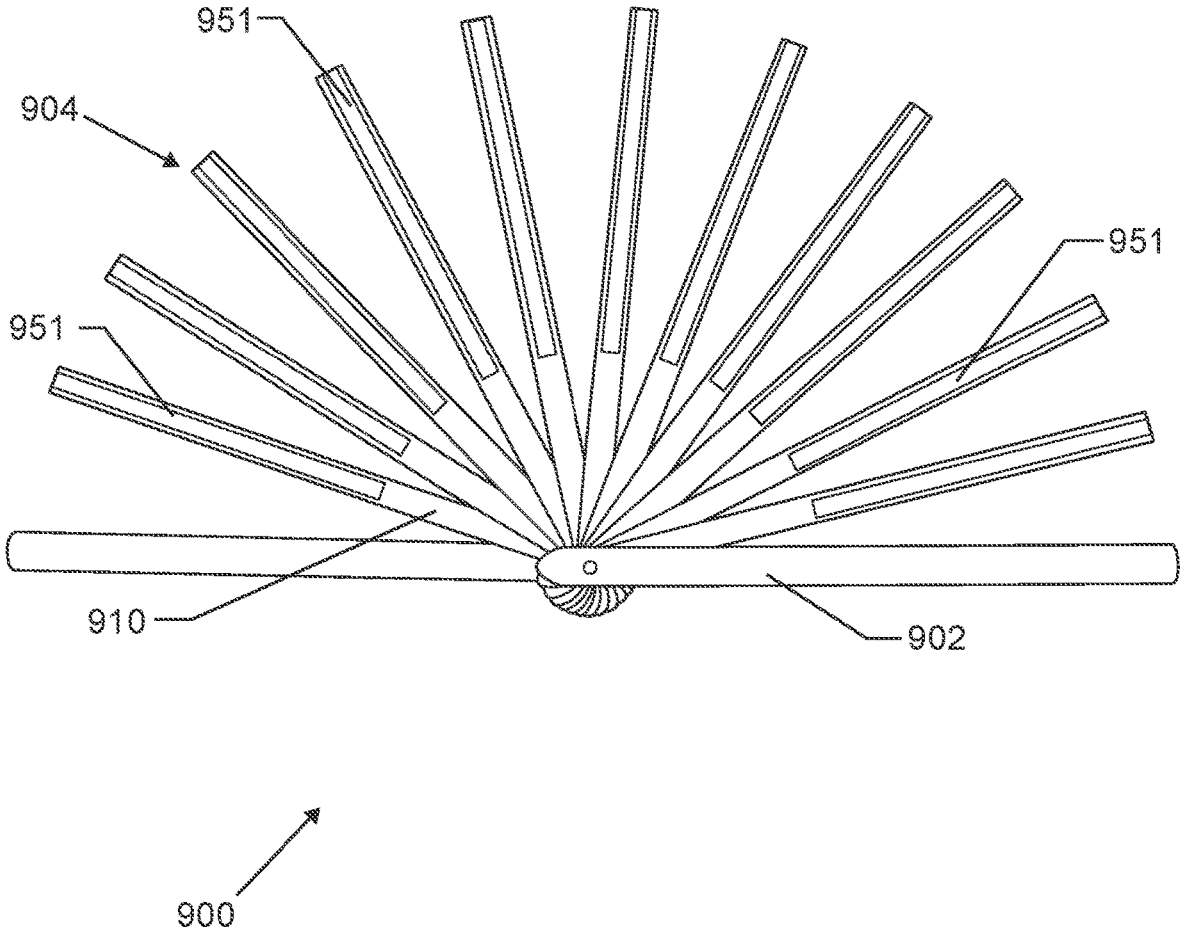
FIG. 9 is an illustration of a front view of a folding hand fand with multiple illuminated ribs.

FIG. 9 is an illustration of a front view of a folding hand fand with multiple illuminated ribs. Folding hand fan 900, which is shown without a leaf, may comprise guards 902 and ribs 904. The ribs 904 may each have a housing 910. In the embodiment shown in FIG. 9, light sources 951 is encased within housing 910. Housing 910 itself may comprise a degree of transparency such that light generated within the housing 910 may pass through the housing 910, wherein the components housed within the housing 910 may, or may not, be visible through the housing 910. The light sources 951 may operate similar to a modern mobile phone, wherein the LED screen is next to the inner surface of the housing 910. FIG. 9 shows that the illuminated ribs may be the interior ribs 904 of the fan 900.

Figure 10:
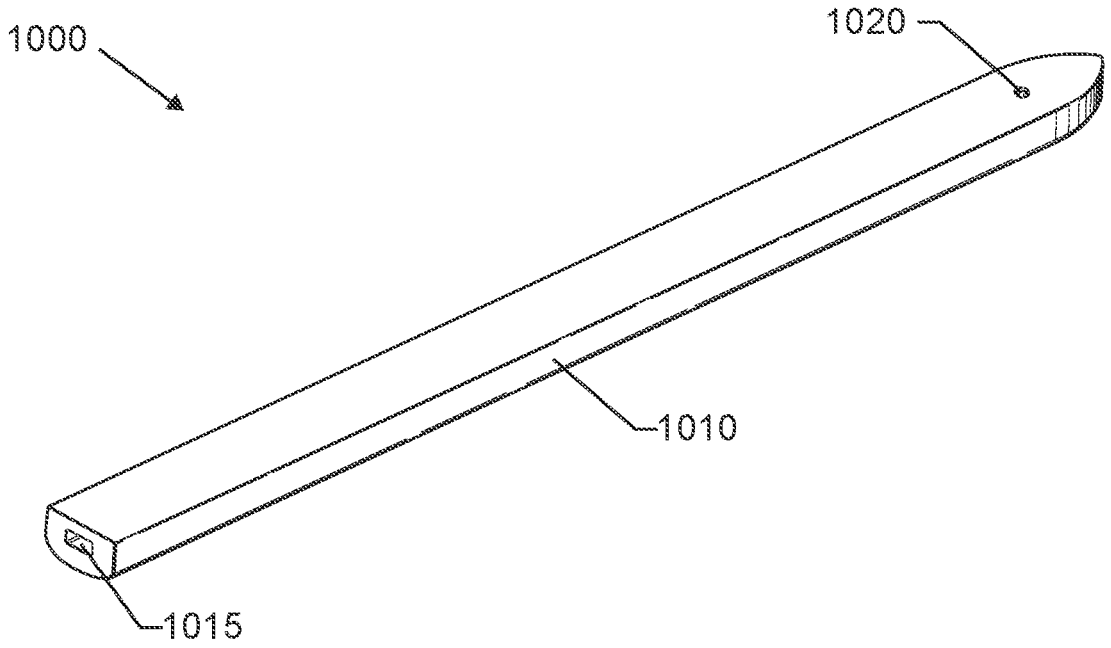
FIG. 10 is an illustration of an interior view of an illuminated rib.

FIG. 10 is an illustration of an interior view of an illuminated rib. As shown in FIG. 10, the front or interior surface of the rib 1000 may have no screens or panels. The rib 1000 may have charging port 1015, rivet hole 1020, and housing 1010. Rib 1000 may be a guard, as shown.

Figure 11:
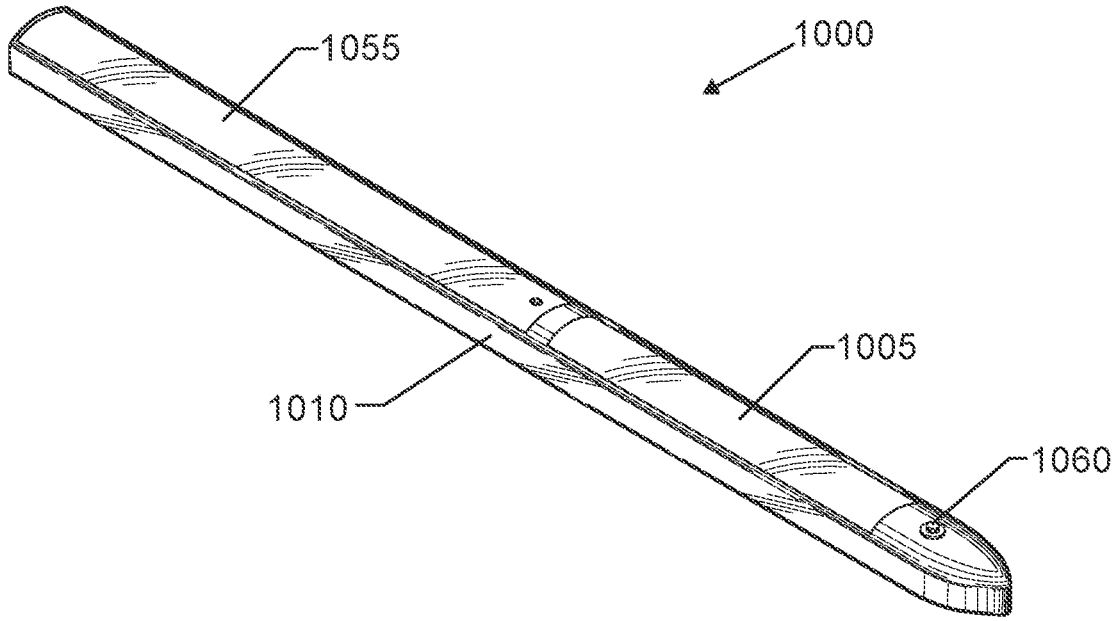
FIG. 11 is an illustration of an exterior view of an illuminated rib.

FIG. 11 is an illustration of an exterior view of an illuminated rib. FIG. 11 shows that the rib 1000 may comprise a housing 1010, a button 1060, panel 1005 and screen 1055. The screen 1055 may be a transparent or translucent portion that allows light from the interior light sources to emanate outward.

Figure 12:
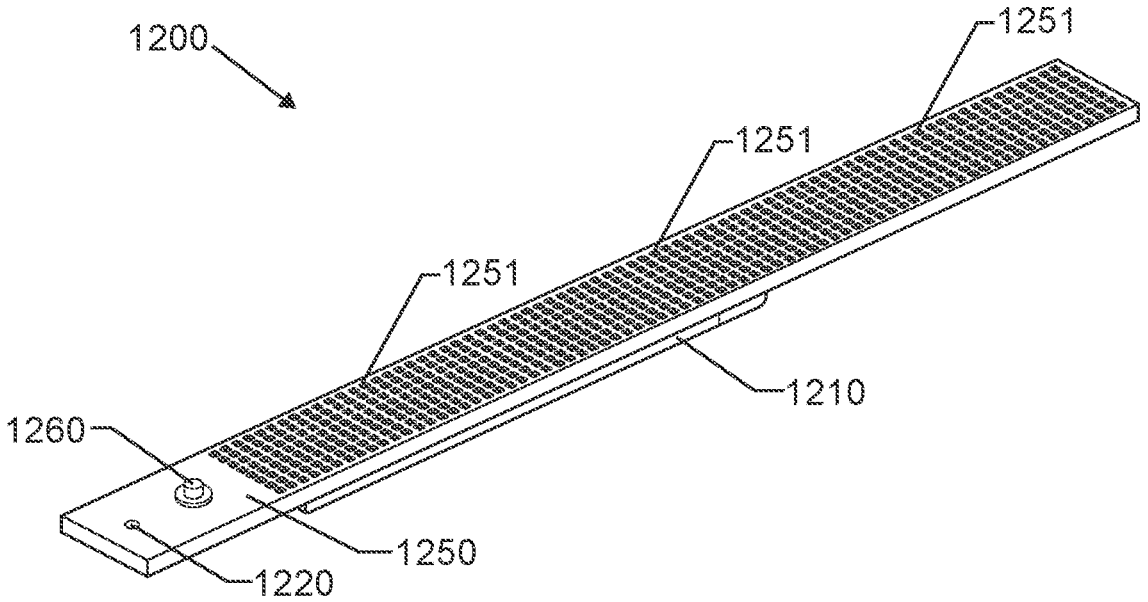
FIG. 12 is an illustration of a perspective view of the lighting assembly of one embodiment of a fan rib.

FIG. 12 is an illustration of a perspective view of the lighting assembly of one embodiment of a fan rib. FIG. 12 shows that the lighting assembly 1200 may have lighting sources 1251, which are preferably a type of LCD or LED light, that cover substantially one side of the lighting board 1250. FIG. 12 shows that the battery 1210 may be on the opposite side of the lighting board 1250 as the lighting sources 1251. The lighting assembly 1200 may have a rivet hole 1220, which allows for greater structural strength.

Figure 13:
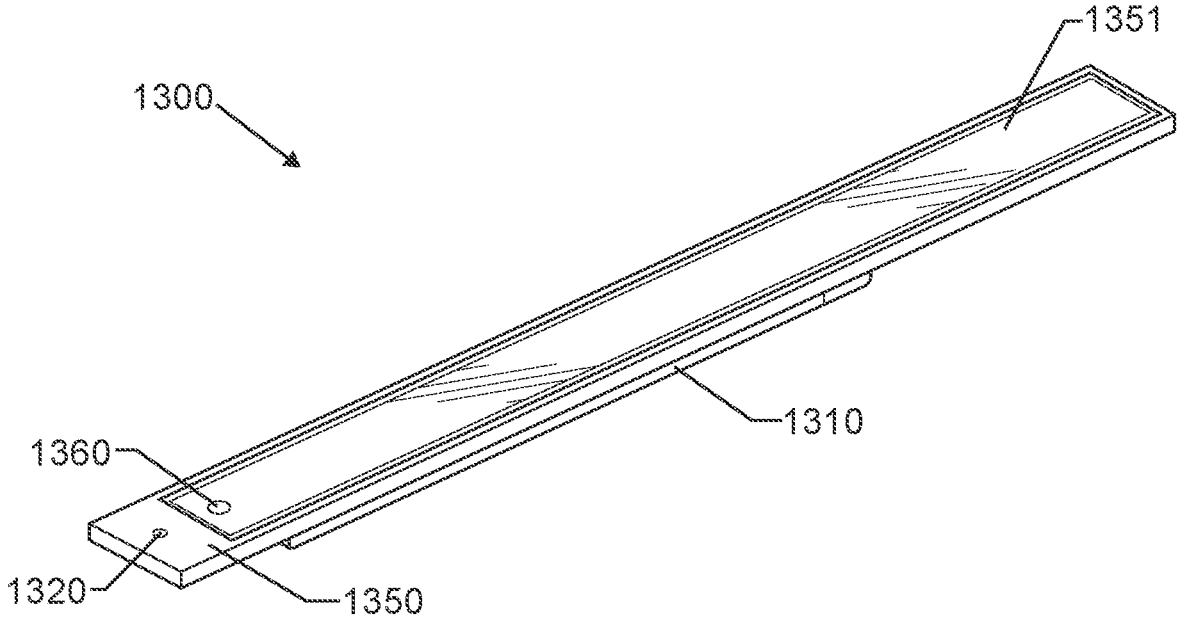
FIG. 13 is an illustration of a perspective view of the lighting assembly of one embodiment of a fan rib.

FIG. 13 is an illustration of a perspective view of the lighting assembly of one embodiment of a fan rib. FIG. 13 shows that the lighting assembly 1300 may comprise screen lighting source 1351, battery 1310, touch pad button 1360, lighting board 1350, and rivet hole 1320. The battery 1310 and the screen 1351 may run along substantially the entire length of the assembly 1300. The screen lighting source 1351 may be an LED or OLED screen (or the like), which allows the user to display programs and multiple colors when illuminated. In this embodiment, screen 1351 may be just on the inside of the housing, which may be partially or entirely translucent or transparent.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection is not limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. An illuminated rib for a folding hand fan comprising:
a housing; and
a lighting assembly, which comprises one or more light sources, a power source, a lighting board, and a control button;
wherein said lighting assembly is configured to be substantially encased within said housing;
wherein when said lighting assembly is turned on a light from said one or more light sources emanates through one or more portions of said housing; and
wherein said illuminated rib for said folding hand fan is configured to be operatively connected to one or more additional ribs and a leaf of said folding hand fan.

2. The illuminated rib for a folding hand fan of claim 1, wherein said control button is configured to turn off said one or more light sources, turn on said one or more light sources, and alter an illumination of said light sources.

3. The illuminated rib for a folding hand fan claim 1, wherein said housing comprises at least one screen that is said one or more portions that said light emanates through.

4. The illuminated rib for a folding hand fan of claim 3, wherein said at least one screen is configured to cover said one or more light sources and allow said light from said one or more light sources to pass through said at least one screen and be visible.

5. The illuminated rib for a folding hand fan of claim 4, wherein said at least one screen is translucent such that said light from said light sources passes through said at least one screen but said one or more light sources are not clearly visible through said at least one screen.

6. The illuminated rib for a folding hand fan of claim 1, wherein said power source comprises a rechargeable battery.

7. The illuminated rib for a folding hand fan of claim 6, wherein said lighting board comprises a charging port that is configured to be accessible through said housing.

8. The illuminated rib for a folding hand fan of claim 1, wherein said power source comprises a wireless charging coil and a rechargeable battery.

9. The illuminated rib for a folding hand fan of claim 1, wherein said lighting board comprises a wireless module that allows said one or more light sources to be controlled wirelessly.

10. The illuminated rib for a folding hand fan of claim 1, wherein said one or more light sources are selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

11. The illuminated rib for a folding hand fan claim 1, wherein said one or more portions that said light emanates through are one or more translucent or transparent portions of said housing.

12. The illuminated rib for a folding hand fan of claim 11, wherein said one or more translucent or transparent portions of said housing are substantially all of said housing.

13. An illuminated rib for a folding hand fan comprising:
a housing; and
a lighting assembly, which comprises one or more light sources, a power source, a lighting board, and a control button;

wherein said power source comprises a battery;

wherein said lighting assembly is configured to be substantially encased within said housing;

wherein when said lighting assembly is turned on a light from said one or more light sources is emanates through one or more translucent or transparent portions of said housing; and wherein said illuminated rib for said folding hand fan is configured to be operatively connected to one or more additional ribs and a leaf of said folding hand fan.

14. The illuminated rib for a folding hand fan of claim 13, wherein said control button is configured to turn off said one or more light sources, turn on said one or more light sources, and alter an illumination of said light sources.

15. The illuminated rib for a folding hand fan of claim 14, wherein said lighting board comprises a wireless module that allows said one or more light sources to be controlled wirelessly.

16. The illuminated rib for a folding hand fan of claim 15, wherein said one or more light sources are selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

17. An illuminated rib for a folding hand fan comprising:

a housing;

one or more light sources;

a battery, and a control button;

wherein said battery and said one or more light sources are configured to be substantially encased within said housing;

wherein said one or more light sources are configured to be adjacent to an inner surface of said housing; and wherein said illuminated rib for said folding hand fan is configured to be operatively connected to one or more additional ribs and a leaf of said folding hand fan.

18. The illuminated rib for a folding hand fan of claim 17, wherein said control button is configured to control said one or more light sources.

19. The illuminated rib for a folding hand fan of claim 18, wherein said one or more light sources are selected from the group of light sources consisting of one or more: light emitting diodes; organic light emitting diodes; full array light emitting diodes; quantum dot light emitting diodes; liquid crystal displays; plasma; electroluminescent sheets; and combinations thereof.

* * * * *